US011105254B2

(12) United States Patent
Loof et al.

(10) Patent No.: US 11,105,254 B2
(45) Date of Patent: Aug. 31, 2021

(54) COOLING SYSTEM AND INTERNAL COMBUSTION ENGINE

(71) Applicant: Volkswagen Aktiengesellschaft, Wolfsburg (DE)

(72) Inventors: Holger Loof, Sickte (DE); Jana Hartmann, Wolfsburg (DE); Bodo Hoffmann, Wolfsburg (DE); Marco Kiel, Magdeburg (DE)

(73) Assignee: VOLKSWAGEN AKTIENGESELLSCHAFT, Wolfsburg (DE)

( * ) Notice: Subject to any disclaimer, the term of this patent is extended or adjusted under 35 U.S.C. 154(b) by 0 days.

(21) Appl. No.: 16/287,428

(22) Filed: Feb. 27, 2019

(65) Prior Publication Data

US 2019/0264600 A1 Aug. 29, 2019

(30) Foreign Application Priority Data

Feb. 27, 2018 (DE) ..... 10 2018 104 409.7

(51) Int. Cl.
*F01P 7/14* (2006.01)
*F01P 3/20* (2006.01)
(Continued)

(52) U.S. Cl.
CPC ..... *F01P 7/14* (2013.01); *F01P 3/20* (2013.01); *F01P 7/165* (2013.01); *F01P 7/167* (2013.01);
(Continued)

(58) Field of Classification Search
CPC ..... F01P 7/167; F01P 7/14; F01P 3/12; F01P 3/20; F01P 7/165; F01P 2005/105; F01P 2005/125; F01P 2060/045; F02M 26/28
(Continued)

(56) References Cited

U.S. PATENT DOCUMENTS 5,215,044 A * 6/1993 Banzhaf ..... F01P 3/20 123/41.05
2006/0005790 A1 1/2006 Braun et al.
(Continued)

FOREIGN PATENT DOCUMENTS

CN 104727927 6/2015
CN 105658927 6/2016
(Continued)

OTHER PUBLICATIONS

Search report for German Patent Application No. 10 2018 104 409.7, dated Oct. 31, 2018.
(Continued)

*Primary Examiner* — Lindsay M Low
*Assistant Examiner* — Omar Morales
(74) *Attorney, Agent, or Firm* — Pearl Cohen Zedek Latzer Baratz LLP

(57) ABSTRACT

A cooling system of an internal combustion engine includes a plurality of components in the form of heat sources, coolant pumps, actuator devices, and temperature sensors that are fluidically connected to one another via coolant lines, wherein a plurality of cooling circuits, each including at least one of the various components, is formed. In addition, a control device is provided that is in signal-conducting connection with at least one of the temperature sensors, with at least one of the coolant pumps, and with at least one of the actuator devices. The control device stores information concerning the association of the individual components with the various cooling circuits and their specific arrangement relative to one another in the individual cooling circuits, information concerning which of the coolant pumps during operation brings about a coolant flow in the individual cooling circuits, information concerning which actuator device(s) may be used to set a volume flow
(Continued)

of the coolant by the individual heat sources, and information concerning a setpoint temperature that is stored for each of the heat sources, The control device also is designed to automatically set a volume flow of coolant through the heat sources that is required for reaching the setpoint temperatures, by appropriate control of the particular coolant pump(s) and actuator device(s).

8 Claims, 8 Drawing Sheets

(51) Int. Cl.
*F01P 7/16* (2006.01)
*F01P 5/12* (2006.01)
*F01P 5/10* (2006.01)

(52) U.S. Cl.
CPC ..... *F01P 2005/105* (2013.01); *F01P 2005/125* (2013.01); *F01P 2023/00* (2013.01); *F01P 2037/02* (2013.01); *F01P 2060/02* (2013.01); *F01P 2060/04* (2013.01); *F01P 2060/045* (2013.01); *F01P 2060/08* (2013.01); *F01P 2060/12* (2013.01)

(58) Field of Classification Search
USPC ..... 123/41.02
See application file for complete search history.

(56) References Cited

U.S. PATENT DOCUMENTS

| | | | |
|---|---|---|---|
| 2009/0211542 | A1 | 8/2009 | Buerrero et al. |
| 2013/0333863 | A1 | 12/2013 | Pawellek |
| 2016/0332505 | A1 | 11/2016 | Yamanaka et al. |
| 2017/0028813 | A1 | 2/2017 | Enomoto et al. |

FOREIGN PATENT DOCUMENTS

| | | | |
|---|---|---|---|
| CN | 107206865 | | 9/2017 |
| CN | 107339142 | | 11/2017 |
| DE | 102 24 063 | A1 | 12/2003 |
| DE | 11 2014 006 161 | T5 | 10/2016 |
| DE | 10 2016 205 488 | A1 | 10/2017 |
| EP | 0 499 071 | A1 | 8/1992 |
| EP | 0 557 113 | A2 | 8/1992 |
| SE | 533942 | | 3/2011 |
| WO | WO 2006/070079 | A1 | 7/2006 |

OTHER PUBLICATIONS

Search report for European Patent Application No. 19157132.2, dated Jun. 26, 2019.
Chinese Office Action for CN Application No. 201910146028.9 dated Oct. 10, 2020.

* cited by examiner

COOLING SYSTEM AND INTERNAL COMBUSTION ENGINE

CROSS REFERENCE TO RELATED APPLICATION

This application claims priority from German Patent Application No. 10 2018 104 409.7, filed Feb. 27, 2018, which is incorporated herein by reference in its entirety.

FIELD OF THE INVENTION

The invention relates to a cooling system, an internal combustion engine having such a cooling system, and a method for operating such an internal combustion engine.

BACKGROUND OF THE INVENTION

Internal combustion engines for motor vehicles generally have a cooling system in which a coolant is pumped in at least one cooling circuit by means of one or more coolant pumps, with absorption of thermal energy by components integrated into the cooling circuit, in particular a combustion engine and an engine oil cooler, a transmission fluid cooler, a cooler of an exhaust gas turbocharger, and/or a charge air cooler. This thermal energy in at least one coolant cooler, sometimes in a heating heat exchanger, is subsequently released to the ambient air, and in the case of the heating heat exchanger is released to the ambient air that is provided for air conditioning the interior of the motor vehicle.

Cooling systems for internal combustion engines in different embodiments are described in DE 11 2014 006 161 T5, US 2013/0333863 A1, and US 2017/0028813 A1.

SUMMARY OF THE INVENTION

The object of the invention is to facilitate the development of complex cooling systems in multiple embodiments, which differ from one another in part, for different uses, i.e., for different internal combustion engines and/or different motor vehicles.

This object is achieved by a cooling system as claimed. An internal combustion engine having such a cooling system and a method for operating such an internal combustion engine are also claimed. Advantageous embodiments of the cooling system according to the invention and of the internal combustion engine according to the invention, as well as preferred embodiments of the method according to the invention, are the subject matter of the further patent claims and/or result from the following description of the invention.

According to the invention, a cooling system in each case having a plurality of components in the form of heat sources, coolant pumps, actuator devices, and temperature sensors that are fluidically connected to one another via coolant lines is provided, wherein a plurality of cooling circuits, each including at least one of the various stated components, is formed, and having a control device that is in signal-conducting connection with at least one and preferably all of the temperature sensors, with at least one and preferably all of the coolant pumps, and with at least one of the actuator devices. It is also provided that the control device stores

- information concerning the association of the individual components with the various cooling circuits and their specific arrangement relative to one another in the individual cooling circuits,

- information concerning which of the coolant pumps during operation brings about a coolant flow in the individual cooling circuits,
- information concerning which actuator device(s) may be used to set a volume flow of the coolant by the individual heat sources, and
- information concerning a setpoint temperature that is stored for each of the heat sources. The control device is also designed to automatically set a volume flow of coolant through the individual heat sources that is required for reaching the setpoint temperatures, by appropriate control of the particular coolant pump(s) and actuator device(s).

The embodiment according to the invention of a cooling system allows the cooling system to be adjusted without having to reconfigure the control device or control software stored therein, since the control device can automatically compute the changes regarding the control of the coolant pump(s) and the actuator device(s) that result from the adjustment of the cooling system. For example, the association of the individual components with the various cooling circuits and/or their specific arrangement relative to one another may change due to the adjustment of the cooling system, which is accordingly stored in the control device and may thus be evaluated for automatically controlling the coolant pump(s) and the actuator device(s). For example, two heat sources A and B may be integrated in succession into a cooling circuit that is supplied with coolant by a specific coolant pump. The temperature of the coolant at the inlet of the second heat source B is a function of the temperature of the coolant at the outlet of the first heat source A. If the two heat sources A and B are exchanged with respect to their relative arrangement in the cooling circuit, the temperature at the inlet of the heat source A is then a function of the temperature of the coolant at the outlet of the heat source B. However, the physical properties of the heat sources A and B and their respective cooling requirements do not change due to this new arrangement. However, as a result of the changed relative arrangement of the heat sources, in order to meet the various cooling requirements it may be necessary to change the volume flow of the coolant in the cooling circuit under consideration, which may be automatically set by an appropriate control of the coolant pump by means of the control device.

The embodiment according to the invention of a cooling system may be advantageously implemented in particular when the cooling system is operable in multiple alternative operating states in which flow passes through various cooling circuits, the appropriate information being stored in the control device for each of the operating states. It may preferably be provided that the control device is designed in such a way that it automatically sets the various operating states as a function of measured values of the temperature sensors.

A cooling system according to the invention may preferably include multiple or all of the following components as heat sources: a cylinder head of a combustion engine, a cylinder housing of the combustion engine, an exhaust gas turbocharger, an EGR cooler, an engine oil cooler, a transmission fluid cooler, a charge air cooler, a metering valve for a reducing agent.

A cooling system according to the invention may also preferably include one or more heat sinks, in particular one or more coolant coolers and/or a heating heat exchanger. It may be advantageous for at least one of the heat sinks to be integrated into each of the cooling circuits.

Furthermore, it may preferably be provided that the cooling system includes

- a first cooling circuit that has multiple or all of the following components: the cylinder head, a first temperature sensor associated with the cylinder head, the exhaust gas turbocharger, the EGR cooler, the heating heat exchanger, an auxiliary coolant pump that is preferably drivable by an electric motor, the engine oil cooler;
- a second cooling circuit that has multiple or all of the following components: the cylinder head, the first temperature sensor associated with the cylinder head, the exhaust gas turbocharger, the EGR cooler, the heating heat exchanger, the auxiliary coolant pump, the engine oil cooler, the coolant cooler or a first of the coolant coolers;
- a third cooling circuit that has multiple or all of the following components: the cylinder head, the first temperature sensor associated with the cylinder head, the engine oil cooler, the (first) coolant cooler, a main coolant pump that is preferably directly or indirectly drivable by a drive shaft of the combustion engine;
- a fourth cooling circuit that has multiple or all of the following components: the cylinder housing, a second temperature sensor associated with the cylinder housing, a thermostatic valve associated with the cylinder housing, the main coolant pump; and
- a fifth cooling circuit that has multiple or all of the following components: the exhaust gas turbocharger, the EGR cooler, the heating heat exchanger, the auxiliary coolant pump.

Such a cooling system according to the invention may also include a sixth cooling circuit that has multiple or all of the following components: the charge air cooler, the metering valve for the reducing agent, an auxiliary coolant pump, a second coolant cooler. The cooling circuits 1 through 5 may also preferably form a first partial cooling system, and the sixth cooling circuit may form a second partial cooling system, the first partial cooling system and the second partial cooling system being separate from one another. A "separate" design of the partial cooling systems is understood to mean that they include no integral section, i.e., no section that is part of a cooling circuit of the one partial cooling system as well as part of a cooling circuit of the other partial cooling system. However, the separate cooling circuits or partial cooling systems may be indirectly connected by a shared expansion tank, in particular via at least one connecting line in each case and one vent line in each case. An "expansion tank" is understood to mean a reservoir for the coolant of the cooling system that is used to compensate for expansion, in particular due to temperature, of the coolant by changing the filling level of the coolant in the expansion tank. For this purpose, such an expansion tank may in particular be filled partially with the coolant and partially with a gas, in particular air. An associated vent line may preferably open into a section of the expansion tank in which the gas is present, while an associated connecting line opens into a section holding the coolant, to allow coolant to flow over between the cooling circuit(s) and the expansion tank, with the primary aim of compensating for temperature-related expansion of the coolant, optionally also for filling the (overall) cooling system with the coolant, for the first time or within the scope of maintenance operations.

An internal combustion engine according to the invention includes at least one combustion engine and a cooling system according to the invention. The combustion engine may preferably include a cylinder housing and a cylinder head that are integrated into the cooling system in each case via at least one coolant duct formed therein.

One advantageous method for operating an internal combustion engine according to the invention that has a cooling system that is operable in the described manner in alternative operating states, and that also includes the stated cooling circuits 1 through 5 and, if present, also the sixth cooling circuit, may be characterized in that (preferably exclusively) either the first or the second cooling circuit and if present, optionally the sixth cooling circuit, are/is used when the combustion engine is not operating. Thus, either a post-heating functionality (when the first cooling circuit is used) may be achieved in which thermal energy, which is still stored in the components of this cooling circuit, may be transmitted via the conveyed coolant in the heating heat exchanger, which likewise is an integral part of the first cooling circuit, to ambient air to be utilized for controlling the temperature of an interior of a motor vehicle, or a post-cooling functionality (when the second cooling circuit is used) may be achieved, by means of which the thermal energy may be dissipated from individual components that are integrated into the second cooling circuit, in particular the cylinder head of the combustion engine and/or the exhaust gas turbocharger, via the further conveyed coolant, and in the (first) coolant cooler may be transmitted to the ambient air. Localized overheating of stationary coolant in these components may thus be avoided. Due to the preferably provided electric motor drive of the auxiliary coolant pump, which is an integral part of the first and the second cooling circuits, such an operation of the cooling system is possible even when the combustion engine is not operating.

Furthermore, it may be provided that (preferably exclusively) the first cooling circuit and, if present, optionally the sixth cooling circuit, are/is used when the combustion engine is operated in a cold start-warmup phase, i.e., when the temperature of the coolant at the coolant outlet of the cylinder head is below a defined limit value (90° C., for example) and when the load requirement is below a limit value. As a result, the thermal energy that arises in particular in the cylinder head and possibly also the exhaust gas turbocharger, which may be the components of the internal combustion engine that heat up most quickly after a cold start, may advantageously be utilized in order to heat up the interior of a motor vehicle as quickly as possible due to heat exchange in the heating heat exchanger. At the same time, flow through the cylinder housing may be prevented, as the result of which the quickest possible heat-up for the cylinder housing may be achieved, since thermal energy that has passed from the combustion chambers of the combustion engine into the cylinder housing is not dissipated by coolant that has passed through the coolant duct of the cylinder housing.

Lastly, it may be provided that (preferably exclusively) the cooling circuits 3 through 5 and, if present, optionally the sixth cooling circuit, are used when the combustion engine is operated in an operating state that differs from the cold start-warmup phase. The coolant may hereby flow through all of the components of the cooling system.

The invention further relates to a motor vehicle having an internal combustion engine according to the invention, which is provided in particular for directly or indirectly providing the propulsion drive power for the motor vehicle. A motor vehicle according to the invention may in particular be a wheel-based, not a rail-bound, motor vehicle (preferably a passenger vehicle or truck).

The indefinite articles "a" and "an," in particular in the claims and in the description which provides a general explanation of the claims, are understood as such, and not as numerals. Accordingly, specific components are to be understood in such a way that they may be present at least once, and may be present multiple times.

BRIEF DESCRIPTION OF THE DRAWINGS

The present invention is explained in greater detail below based on one exemplary embodiment that is illustrated in the drawings, which show the following.

DETAILED DESCRIPTION OF THE INVENTION

Figure 1:
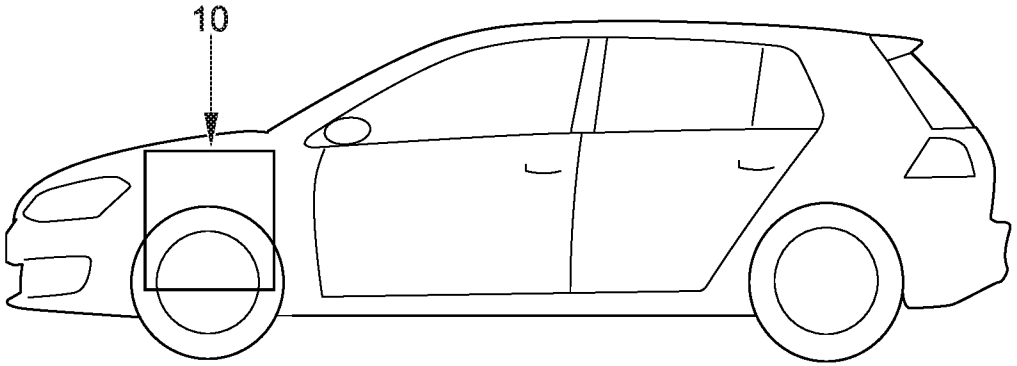
FIG. 1: shows a motor vehicle according to the invention.

FIG. 1 shows a simplified illustration of a motor vehicle according to the invention, including an internal combustion engine 10 according to the invention. According to FIG. 2, such an internal combustion engine 10 may have a combustion engine 12 which, for example, may be designed as a reciprocating piston engine that operates according to the diesel principle, and which may include a cylinder housing 14 with cylinders provided therein, and a cylinder head 16. In addition, the internal combustion engine 10 according to FIG. 2 has a cooling system with a main cooling system as the first partial cooling system, and a secondary cooling system as the second partial cooling system.

The main cooling system is used for cooling the combustion engine 12, engine oil for lubricating the combustion engine 12, transmission fluid of a manual or automatic transmission (not illustrated) associated with the combustion engine 12, an exhaust gas turbocharger 18, in particular a thrust bearing thereof, and exhaust gas that is recirculated via an exhaust gas recirculation line (not illustrated) of a low-pressure or high-pressure recirculation system.

For this purpose, the main cooling system includes cooling ducts of the cylinder housing 14 and of the cylinder head 16, an engine oil cooler 20, a transmission fluid cooler 22, a cooler for the exhaust gas turbocharger 18 which is designed in the form of a cooling duct in a housing of the exhaust gas turbocharger 18, a cooler for a cooling duct in an exhaust gas recirculation valve 24, and an EGR cooler 26, i.e., a heat exchanger through which coolant of the cooling system as well as exhaust gas to be returned via the exhaust gas recirculation line flow. In addition, the main cooling system includes a first coolant cooler 28 as the main cooler of the cooling system, a main coolant pump 30, an auxiliary coolant pump 32, and a heating heat exchanger 34. The main cooler 28 is used to recool the coolant flowing through same via the passage of thermal energy to the ambient air, which flows through the main cooler 34 at the same time. The heating heat exchanger 34 is used, as needed, to heat up ambient air that is provided for air conditioning an interior of a motor vehicle that includes the internal combustion engine 10 (according to FIG. 1). The main coolant pump 30 of the main cooling system is indirectly, i.e., mechanically, driven by a crankshaft 38 of the combustion engine 12 via a toothed belt 36. The main coolant pump may be designed to be controllable or regulatable with regard to the specific output (i.e., in each case based on the drive speed), and also designed so that it can be switched off; i.e., it does not generate any relevant output, despite a drive. In addition, it may be provided that flow through the main coolant pump 30 is prevented or enabled in the driven as well as in the nondriven state thereof. In contrast, the auxiliary coolant pump 32 is drivable by an electric motor.

The various heat exchange components and coolant pumps 30, 32 are integrated into various cooling circuits of the main cooling system. A distribution of the coolant, conveyed via the coolant pumps 30, 32, over the various cooling circuits, and thus the flow through the individual cooling circuits, may be controlled by means of actuator devices that include a distributor device 40 (only functionally illustrated in FIG. 2) based on a rotary vane, a self-regulating first thermostatic valve 42 (opening temperature: approximately 105° C., for example) associated with the cooling duct of the cylinder housing 14, and a self-regulating second thermostatic valve 44 (opening temperature: approximately 75° C., for example) associated with the transmission fluid cooler 24. The actuator devices as well as the main coolant pump 30 and the auxiliary coolant pump 32 are controllable by means of a control device (engine control unit) 80.

Figure 3:
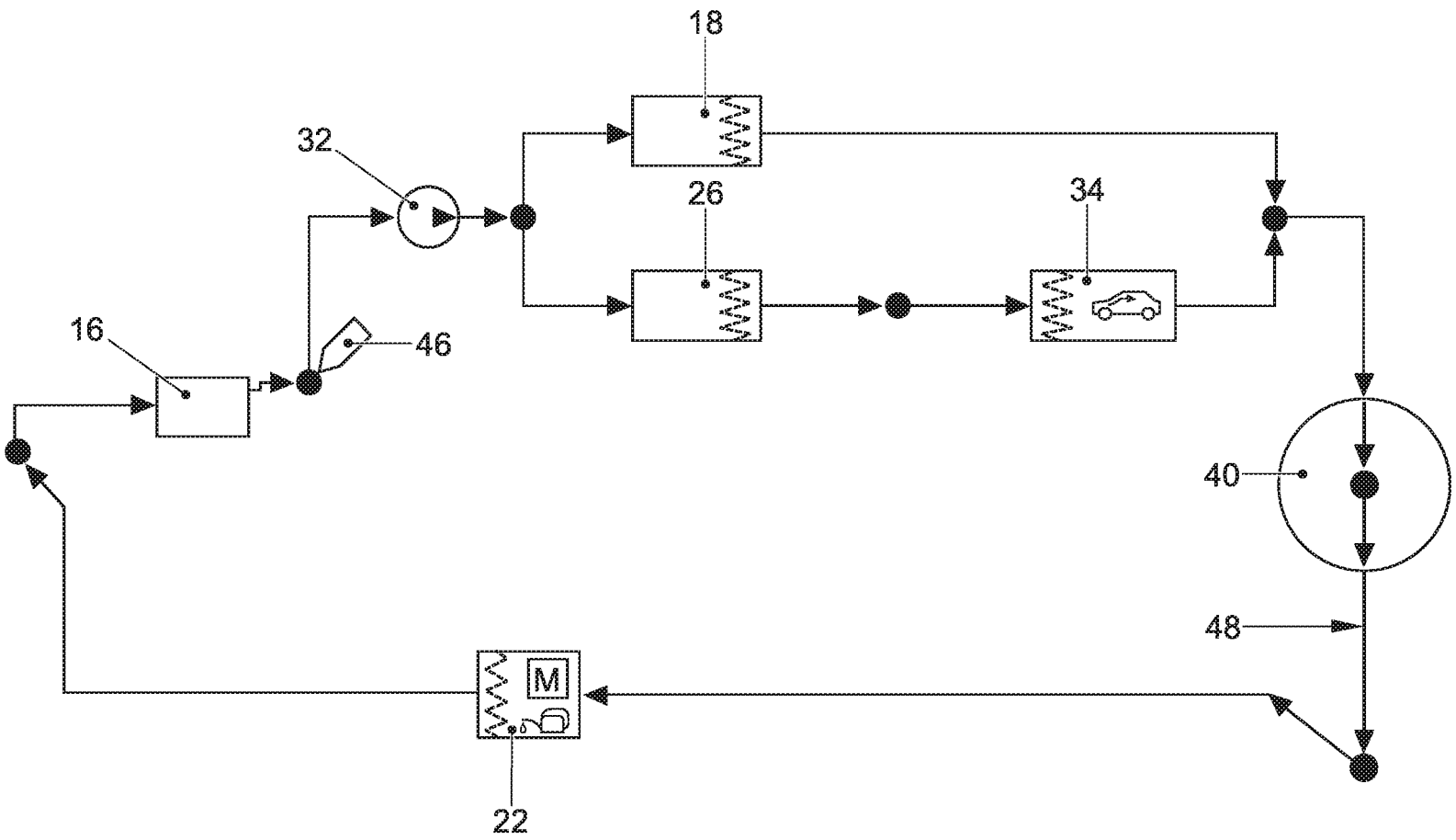
FIG. 3: shows a first cooling circuit of a cooling system of the internal combustion engine.

A first cooling circuit (see FIG. 3) includes the cylinder head 16, a first temperature sensor 46 that is associated with the cylinder head 16 and in particular situated directly on the outlet side of the cylinder head 16, and that is in signal-conducting connection with the control device 80; the auxiliary coolant pump 32, the exhaust gas turbocharger 18, the EGR cooler 26, the heating heat exchanger 34, the distributor device 40, and the engine oil cooler 22. Downstream from the auxiliary coolant pump 38, the first cooling circuit is divided into two tracts running in parallel, with the EGR cooler 26, and downstream therefrom the heating heat exchanger 34, being integrated into a first of these tracts, and the cooling duct of the exhaust gas turbocharger 18 being integrated into the second tract.

Figure 4:
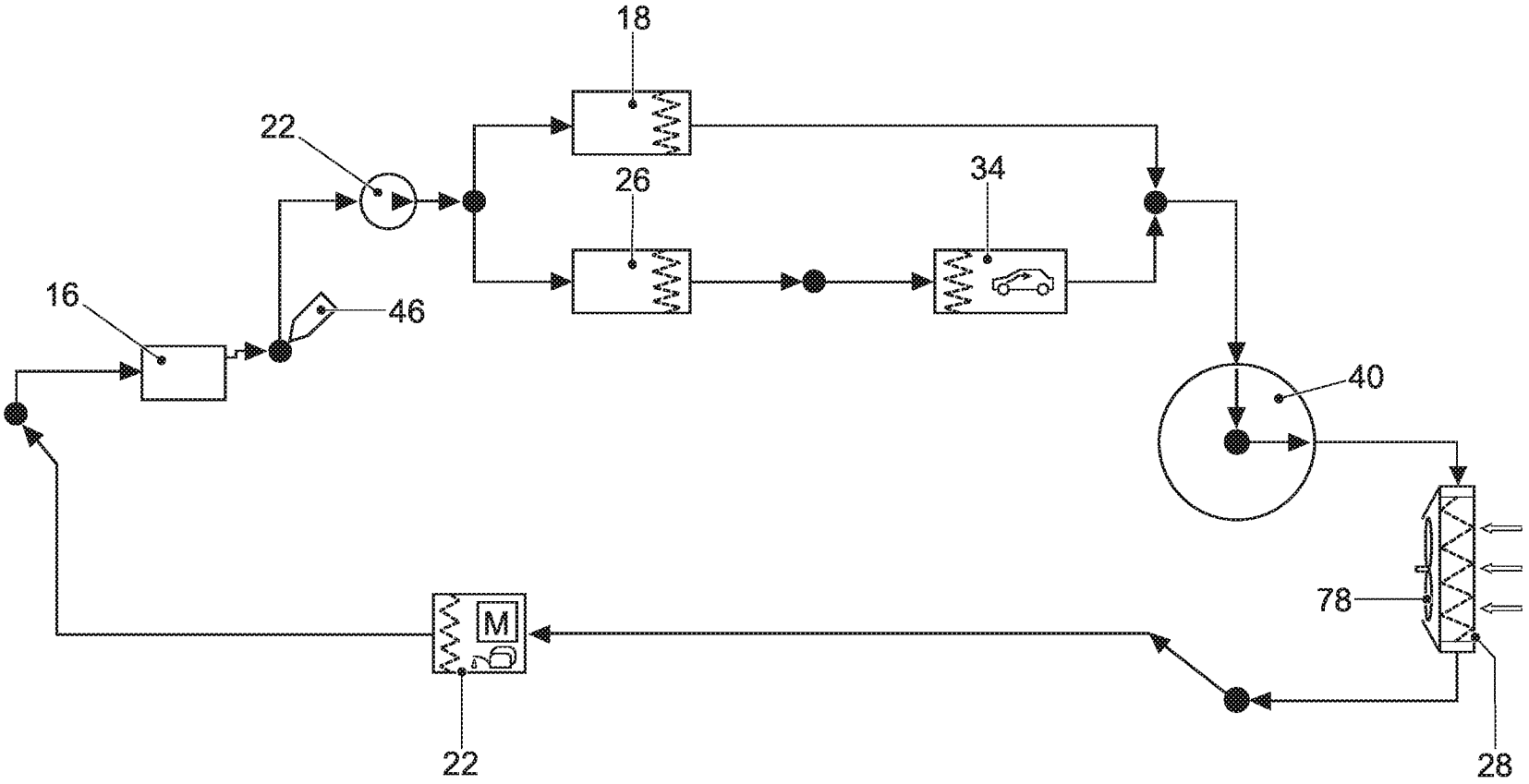
FIG. 4: shows a second cooling circuit of the cooling system of the internal combustion engine.

A second cooling circuit (see FIG. 4) essentially corresponds to the first cooling circuit, with the exception that instead of a cooler bypass 48 by means of which a coolant flow may be led past the main cooler 28, the main cooler 28 is integrated into the cooling circuit.

Figure 5:
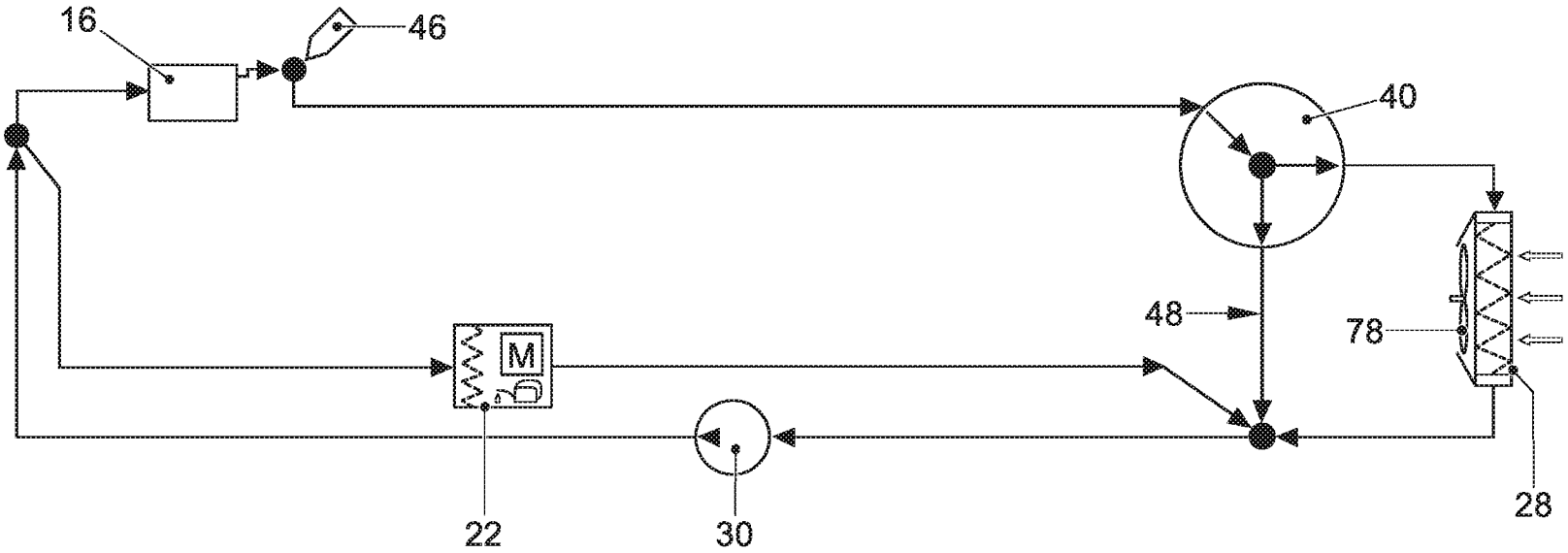
FIG. 5: shows a third cooling circuit of the cooling system of the internal combustion engine.

A third cooling circuit (see FIG. 5) includes the cylinder head 16, the first temperature sensor 46 associated with the cylinder head 16, the distributor device 40, the main cooler 28, the cooler bypass 48, the main coolant pump 30, and the engine oil cooler 22.

Figure 6:
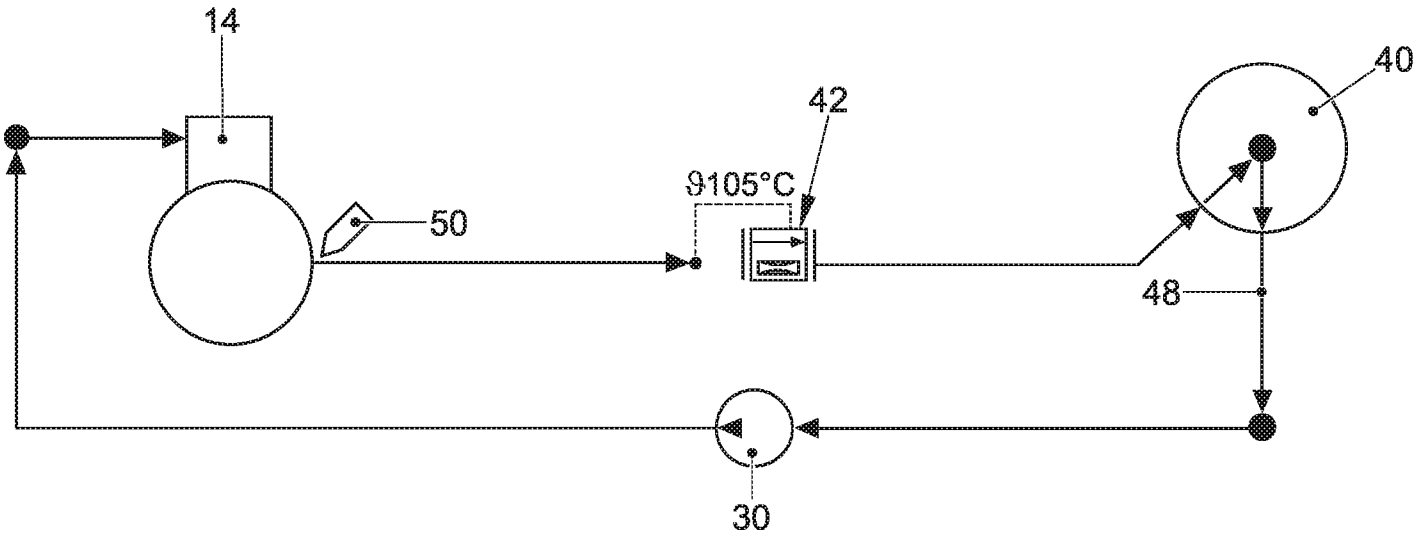
FIG. 6: shows a fourth cooling circuit of the cooling system of the internal combustion engine.

A fourth cooling circuit (see FIG. 6) includes the cylinder housing 14, a second temperature sensor 50 that is associated with the cooling duct of the cylinder housing 14 and in particular situated directly on the outlet side of the cylinder head housing 14, and that is likewise in signal-conducting connection with the control device 80, the first thermostatic valve 42 associated with the cooling duct of the cylinder housing 14, the distributor device 40, and the main coolant pump 30. The first thermostatic valve 42 as well as a thermostat bypass 52 that bypasses this first thermostatic valve 42 are integrated into the distributor device 40 (see FIG. 2), wherein the thermostat bypass 52 may be blocked or enabled, as needed, by means of the rotary vane of the distributor device 40.

Figure 7:
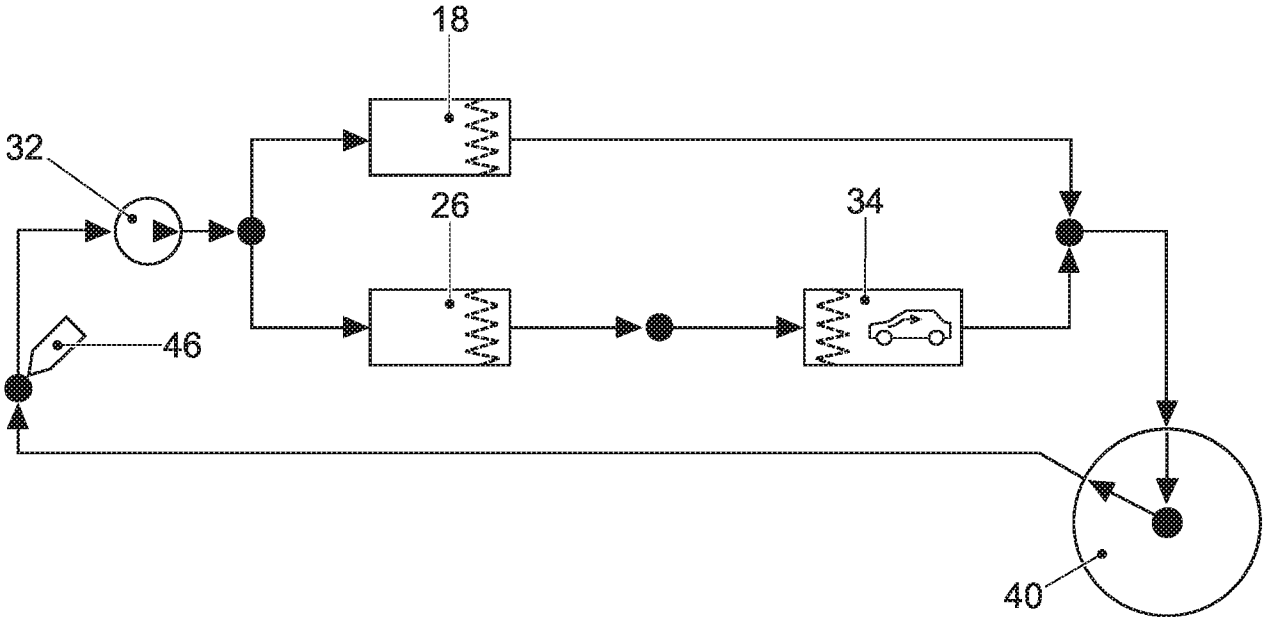
FIG. 7: shows a fifth cooling circuit of the cooling system of the internal combustion engine.

A fifth cooling circuit (see FIG. 7) includes the auxiliary coolant pump 32, the exhaust gas turbocharger 18, the EGR cooler 26, the heating heat exchanger 34, and the distributor device 40.

Figure 8:
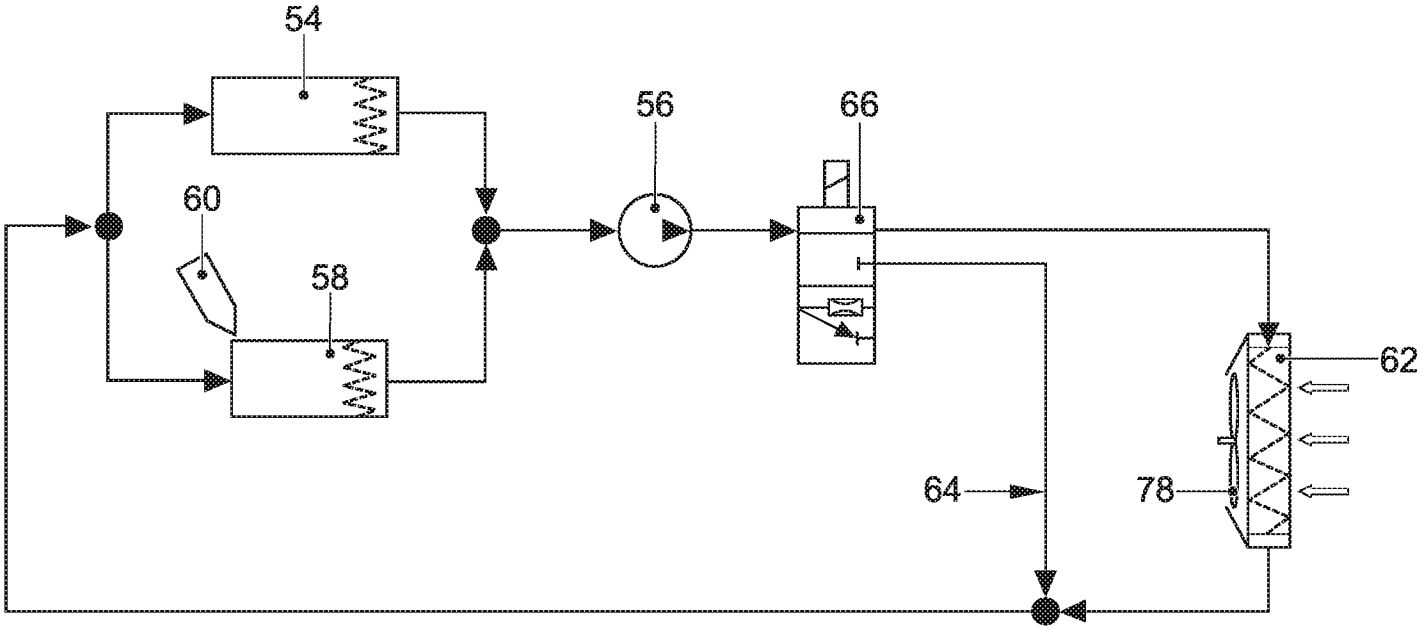
FIG. 8: shows a sixth cooling circuit of the cooling system of the internal combustion engine.

The secondary cooling system is used to cool the fresh gas (charge air) that is charged at least by means of a compressor of the exhaust gas turbocharger 18, and that is supplied to the combustion engine 12 via a fresh gas tract (not illustrated) of the internal combustion engine 10. In addition, the secondary cooling system is used to cool a metering valve 54, by means of which a reducing agent in the exhaust gas that flows through an exhaust tract (not illustrated) of the internal combustion engine 10 may be introduced in order to reduce pollutants, in particular nitrogen oxides, in the exhaust gas by means of selective catalytic reduction. The charge air cooler 58 provided for cooling the charge air and the cooling duct provided for cooling the metering valve 54 are integrated into two parallel tracts of a sixth cooling circuit (also see FIG. 8) of the (overall) cooling system. A third temperature sensor 60 is associated with the charge air cooler 58 on the inlet side. In addition, a secondary coolant pump 56 that is drivable by an electric motor, and a second coolant cooler (auxiliary cooler) 62 that is used to recool the coolant flowing through the (sixth) cooling circuit of the secondary cooling system, are integrated into the sixth cooling circuit in the section that is not divided into the two parallel tracts. The auxiliary cooler 62 may be bypassed by means of a cooler bypass 64, wherein a distribution of the coolant flowing through the cooling circuit of the secondary cooling system may be changed to either the auxiliary cooler 62 or the associated cooler bypass 64 by means of a control valve 66.

The secondary coolant pump 56 and the control valve 66 are in turn controlled by means of the control device 80, which also transmits the measuring signals of the third temperature sensor 60.

During warm operation of the internal combustion engine 10, the temperature of the coolant is much higher, at least in sections, in the main cooling system than in the secondary cooling system, so that the former may also be referred to as a high-temperature cooling system, and the latter, as a low-temperature cooling system.

The cooling system also includes an expansion tank 68 (see FIG. 2) that is filled partly with the coolant and partly with air. The expansion tank 68 is fluidically connected to the main cooling system and to the secondary cooling system via a connecting line 70 that leads from the (lower) section of the expansion tank 68 that holds the coolant. In addition, vent lines 72 connect the cooling circuits of the main cooling system and of the secondary cooling system to the (upper) section of the expansion tank 68 that accommodates air, with either a check valve 74 or a throttle 76 connected in between.

Figure 2:
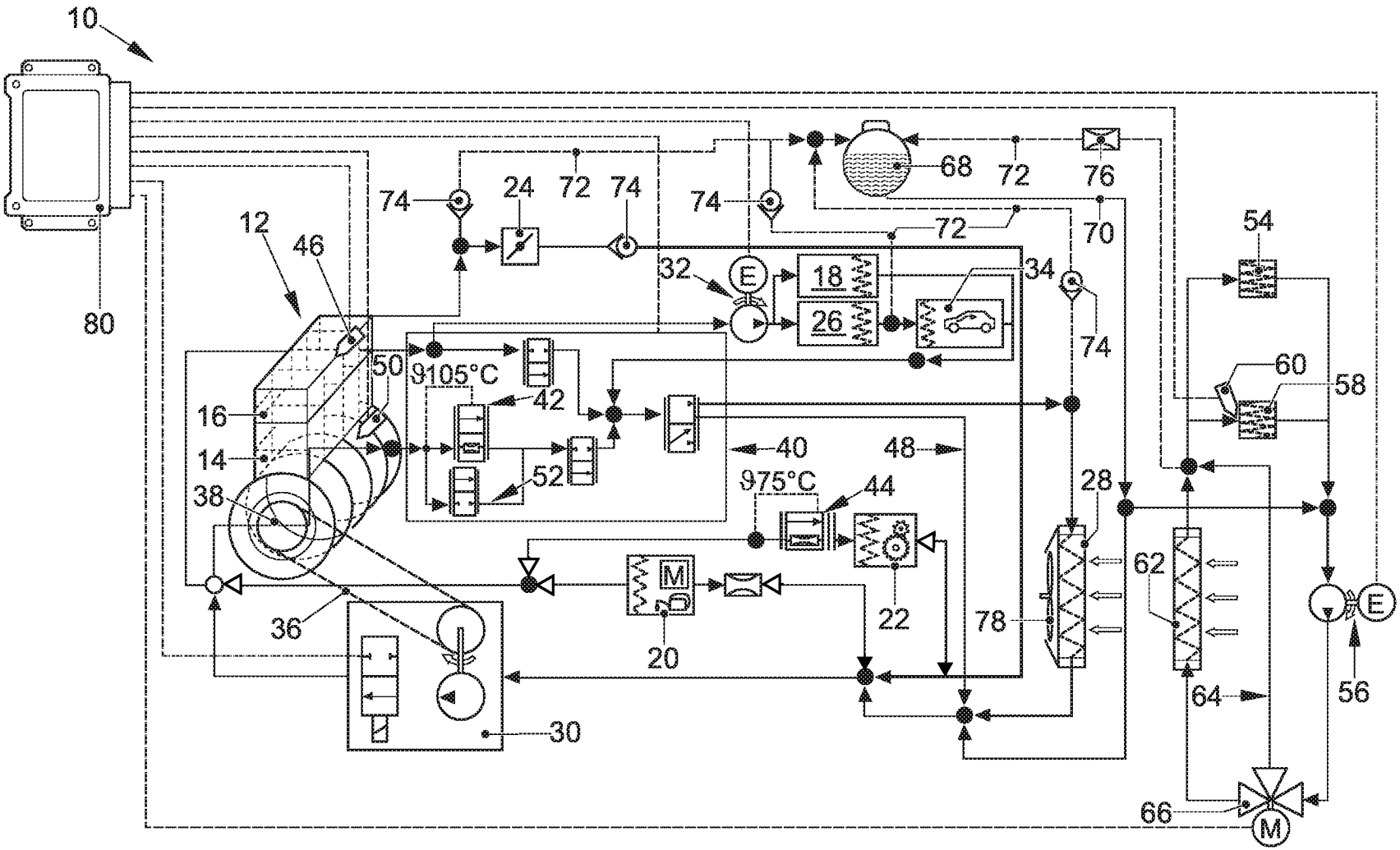
FIG. 2: shows an internal combustion engine according to the invention in a schematic illustration.

The main cooling system of the cooling system according to FIG. 2 may be operated as follows.

During a first portion of a warmup phase of the combustion engine 12, which is referred to as a cold start-warmup phase, and during which the coolant has a temperature, measured by the first temperature sensor 46, in particular due to a previous cold start of the combustion engine 12, that is still below a first limit value (90° C., for example), it is provided that flow through the main coolant pump 30 is prevented. During this cold start-warmup phase, this causes coolant to be conveyed in the main cooling system solely by means of the auxiliary coolant pump 32, which may be operated with variable output. In conjunction with a first position of the distributor device 40, coolant is hereby conveyed in the first cooling circuit with a (total) volumetric flow of approximately 10 L/min, for example. The coolant flows through the cooling duct of the exhaust gas turbocharger 18, the EGR cooler 26, and the heating heat exchanger 34. In addition, the coolant flows through the cooler bypass 48, which likewise represents a section of the first cooling circuit, and through the engine oil cooler 20 (in a flow direction opposite to that during warm operation of the internal combustion engine 10; see white arrowheads in FIG. 2) and the cooling duct of the cylinder head 16. Flow through the cooling duct of the cylinder housing 14 is also completely prevented. During the cold start-warmup phase, flow through the transmission fluid cooler 28 is prevented, at least initially, by means of the second thermostatic valve 44 as a function of the temperature of the coolant flowing through the first cooling circuit.

During operation of the main cooling system based on the first position of the distributor device 40, the thermal energy that arises in particular in the cylinder head 16 and in the exhaust gas turbocharger 18 may advantageously be utilized to heat up an interior of the motor vehicle as quickly as possible, as well as to achieve defined temperature control of the EGR cooler 26, due to heat exchange in the heating heat exchanger 34. At the same time, flow through the cooling duct of the cylinder housing 14 is prevented, as the result of which the quickest possible heat-up for the cylinder housing may be achieved, since thermal energy that has passed from the combustion chambers in the cylinder housing 14, delimited by the cylinders, is not dissipated by coolant that has passed through the coolant duct 22 of the cylinder housing 14.

The first position of the distributor device 40 may also be advantageously utilized to control the temperature of the interior of the motor vehicle when the combustion engine 12 is not in operation, which may be provided based on an automatic start-stop functionality of the combustion engine 12, or also by manually switching off the combustion engine 12. The thermal energy that is stored in the other components of the main cooling system through which flow passes, and that is transferred to the coolant during the throughflow, is hereby advantageously used in the heating heat exchanger 34 to heat the ambient air used for controlling the temperature of the interior of the motor vehicle. One possible difference of this reheating operation from the cold start-warmup phase is that the flow through the main coolant pump 30 takes place at least to a relatively small extent, which is not provided for the first portion of the warmup phase.

A second position of the distributor device 40 is set during a second portion of the warmup phase. A portion of the coolant flow coming from the cylinder head 16 is led through the cooler bypass 48 while bypassing the heating heat exchanger 34. Relevant cooling power for the cylinder head 16 may already be achieved in this way, so that imminent localized thermal overloading of the coolant flowing through the cylinder head 16 may be reliably prevented. For this purpose, it may also be provided that in the second position of the distributor device 40, flow through the main coolant pump 30 that is driven by the combustion engine 12 is enabled, and its output is adjusted so that a sufficient volume flow of the coolant through the cylinder head 16 of approximately 50 L/min, for example, results. Flow through the main cooler 28 is also not provided in the second position of the distributor device 40, since the thermal energy introduced into the coolant then does not have to be dissipated by recooling the coolant in the main cooler 28.

The thermostat bypass 52 is enabled in an auxiliary position of the distributor device 40, which in other respects corresponds to the second position, when flow through the cooling duct of the cylinder housing 14 is to be achieved, despite the coolant still being relatively cold. This is the case in particular when there is a requirement for a high, in particular maximum, load during operation of the combustion engine 12 when the coolant is still relatively cold (<94° C., for example).

A third position of the distributor device 40, which is set during a third portion of the warmup phase, differs from the second position solely in that the distributor device 40 allows coolant flow through the cylinder housing 14. As a result, at least a pilot flow through the cooling duct of the cylinder housing 14 is made possible, which is used to control the temperature of the first thermostatic valve 42 in order to provide it with the option of automatically regulating flow through the cooling duct of the cylinder housing 14 during further heating of the coolant.

In a fourth position of the distributor device 40, which is set during warm operation of the internal combustion engine, and thus, when the temperature of the coolant is in the intended normal operating temperature range or at least not below it (>94° C., for example), the entire quantity of coolant that arrives at the distributor device 40 is led across the main cooler 28. Maximum cooling power of the main cooling system is achieved in this way. This fourth position of the distributor device 40 is provided in particular during operation of the combustion engine 12 under relatively high load, in particular in combination with a relatively low travel speed of the motor vehicle that includes the internal combustion engine 10, and/or at a relatively high ambient temperature, and thus with relatively low cooling power of the main cooler 28.

In other operating states of the internal combustion engine 10 during warm operation, the cooling power that is achieved in the fourth position may be great enough that cooling of the coolant below the intended operating temperature range would result. To prevent this, the distributor device 40 is then set in an intermediate position between the third position and the fourth position, in which a first outlet that is connected to the main cooler 28, and a second outlet that is connected to the cooler bypass 48, are partially enabled and partially blocked to different extents relative to one another. The recooling of the coolant in the main cooler 28 may thus be controlled or regulated as needed in order to set a preferably constant temperature of the coolant of approximately 95° C., for example, measured by the first temperature sensor 46 associated with the cooling duct of the cylinder head 16.

The distributor device 40 may also be set in a neutral position in which a coolant flow coming from the cylinder head 16 is led completely across the heating heat exchanger 34 and subsequently to the main cooler 28. The neutral position is set when recooling is meaningful for certain components or heat sources of the cooling system, in particular the exhaust gas turbocharger 18 and the cylinder head 16, during nonoperation after a preceding operation of the combustion engine 12 under relatively high load. For this purpose, coolant is then conveyed in the second cooling circuit according to FIG. 4 by means of the auxiliary coolant pump 32. In such an operation of the cooling system, coolant flows through the cylinder head 16 and the exhaust gas turbocharger 18, among other components, which in the preceding operation of the combustion engine 12 were subjected to high thermal load, as the result of which residual heat from these heat sources is dissipated by the coolant, and after likewise flowing through the main cooler 28 is transferred to the ambient air. A fan 78 that is associated with the main cooler 28 and driven by an electric motor may likewise be operated to ensure sufficient removal of the thermal energy via the main cooler 28.

The secondary cooling system, and thus the sixth cooling circuit of the (overall) cooling system, are operated or utilized in all described operating states of the internal combustion engine.

LIST OF REFERENCE NUMERALS

10 internal combustion engine
12 combustion engine
14 cylinder housing
16 cylinder head
18 exhaust gas turbocharger
20 engine oil cooler
22 transmission fluid cooler
24 exhaust gas recirculation valve
26 EGR cooler
28 first coolant cooler/main cooler
30 main coolant pump of the main cooling system
32 auxiliary coolant pump of the main cooling system
34 heating heat exchanger
36 toothed belt
38 crankshaft of the combustion engine
40 distributor device/actuator device
42 first thermostatic valve/actuator device
44 second thermostatic valve/actuator device
46 first temperature sensor
48 cooler bypass of the main cooling system
50 second temperature sensor
52 thermostat bypass
54 metering valve
56 secondary coolant pump
58 charge air cooler
60 third temperature sensor
62 second coolant cooler/auxiliary cooler
64 cooler bypass of the secondary cooling system
66 control valve
68 expansion tank
70 connecting line
72 vent line
74 check valve
76 throttle
78 fan
80 control device

The invention claimed is:

1. A cooling system comprising: a plurality of components in the form of heat sources, coolant pumps, actuator devices, and temperature sensors that are fluidically connected to one another via coolant lines, a plurality of cooling circuits, each including at least one of the various components, the cooling circuits including: a first cooling circuit that has multiple or all of the following components: a cylinder head, a first temperature sensor associated with the cylinder head, an exhaust gas turbocharger, an EGR cooler, a heating heat exchanger, an auxiliary coolant pump, and an engine oil cooler; a second cooling circuit that has multiple or all of the following components: the cylinder head, the first temperature sensor associated with the cylinder head, the exhaust gas turbocharger, the EGR cooler, the heating heat exchanger, the auxiliary coolant pump, the engine oil cooler, and a coolant cooler or a first of one or more coolant coolers; a third cooling circuit that has multiple or all of the following components: the cylinder head, the first temperature sensor associated with the cylinder head, the engine oil cooler, the first coolant cooler, and a main coolant pump; a fourth cooling circuit that has multiple or all of the following components: a cylinder housing, a second temperature sensor associated with the cylinder housing, a thermostatic valve associated with the cylinder housing, and the main coolant pump; and a fifth cooling circuit that has multiple or all of the following components: the exhaust gas turbocharger, the EGR cooler, the heating heat exchanger, and the auxiliary coolant pump; and a sixth cooling circuit that has multiple or all of the following components: a charge air cooler, a metering valve, a secondary coolant pump, and a second coolant cooler; and a control device that is in signal-conducting connection with at least one of the temperature sensors, with at least one of the coolant pumps, and with at least one of the actuator devices, wherein the control device stores information concerning the association of the individual components with the various cooling circuits and their specific arrangement relative to one another in the individual cooling circuits, information concerning which of the coolant pumps during operation brings about a coolant flow in the individual cooling circuits, information concerning which actuator device(s) may be used to set a volume flow of the coolant by the individual heat sources, and information concerning a setpoint temperature that is stored for each of the heat sources, wherein the control device is designed to automatically set a volume flow of coolant through the heat sources that is required for reaching the setpoint temperatures, by appropriate control of the particular coolant pump(s) and actuator device(s).

2. The cooling system according to claim 1, wherein the cooling system is operable in multiple alternative operating states in which flow passes through various cooling circuits, the appropriate information being stored in the control device for each of the operating states.

3. The cooling system according to claim 2, wherein the control device is configured to automatically set the various operating states as a function of measured values of the temperature sensors.

4. The cooling system according to claim 1, further comprising as heat sources multiple or all of the following components: the cylinder head of a combustion engine, the cylinder housing of the combustion engine, the exhaust gas turbocharger, the EGR cooler, the engine oil cooler, a transmission fluid cooler, the charge air cooler, and a the metering valve for a reducing agent; and further comprising as heat sinks multiple or all of the following components: the one or more coolant coolers, and the heating heat exchanger.

5. The cooling system according to claim 1, wherein the first through fifth cooling circuits form a first partial cooling system, and the sixth cooling circuit forms a second partial cooling system, the first partial cooling system and the second partial cooling system being separate from one another.

6. An internal combustion engine having a combustion engine and having a cooling system according to claim 1.

7. A method for operating an internal combustion engine having a combustion engine and having a cooling system according to claim 1, wherein: either the first cooling circuit or the second cooling circuit and optionally also the sixth cooling circuit is/are used when the combustion engine is not operating; the first cooling circuit and optionally the sixth cooling circuit is/are used when the combustion engine is in a cold start-warmup phase, i.e., when the temperature of the coolant at the coolant outlet of the cylinder head is below a limit value and when the load requirement is below a limit value; and the third through fifth cooling circuits and optionally the sixth cooling circuit are used when the combustion engine is operated in an operating state that differs from the cold start-warmup phase.

8. The method according to claim 7, wherein the sixth cooling circuit is used when the combustion engine is not operated and/or is operated in the cold start-warmup phase and/or is operated in an operating state that differs from the cold start-warmup phase.

* * * * *